US008189795B2

(12) United States Patent
Konagai

(10) Patent No.: US 8,189,795 B2
(45) Date of Patent: May 29, 2012

(54) SOUND SIGNAL OUTPUTTING DEVICE, SOUND SIGNAL OUTPUTTING METHOD, AND COMPUTER-READABLE RECORDING MEDIUM

(75) Inventor: Yusuke Konagai, Hamamatsu-shi (JP)

(73) Assignee: Yamaha Corporation (JP)

( * ) Notice: Subject to any disclaimer, the term of this patent is extended or adjusted under 35 U.S.C. 154(b) by 545 days.

(21) Appl. No.: 12/397,858

(22) Filed: Mar. 4, 2009

(65) Prior Publication Data

US 2009/0225992 A1 Sep. 10, 2009

(30) Foreign Application Priority Data

Mar. 5, 2008 (JP) ..... 2008-054491

(51) Int. Cl.
*H04R 5/00* (2006.01)

(52) U.S. Cl. ..... 381/1; 381/17; 381/300

(58) Field of Classification Search ..... 381/1, 17–19, 381/300, 307, 310
See application file for complete search history.

(56) References Cited

U.S. PATENT DOCUMENTS

| | | | |
|---|---|---|---|
| 5,771,295 | A | 6/1998 | Waller, Jr. |
| 2007/0286427 | A1 | 12/2007 | Jung |

FOREIGN PATENT DOCUMENTS

| | | | |
|---|---|---|---|
| EP | 0 608 937 | A1 | 8/1994 |
| EP | 1 694 097 | A1 | 8/2006 |
| EP | 1 871 143 | A1 | 12/2007 |
| JP | 07-059200 | A | 3/1995 |
| JP | 9-289700 | A | 11/1997 |
| JP | 2006-238155 | A | 9/2006 |
| WO | 03/049497 | A2 | 6/2003 |
| WO | 2006/057521 | A1 | 6/2006 |

OTHER PUBLICATIONS

Extended European Search Report issued in corresponding European Patent Application No. 09003228.5 dated Jun. 23, 2009.
Notification of Reasons for Refusal issued in corresponding Japanese Patent Application No. 2008-054491 dated Nov. 10, 2009. English translation only provided.

*Primary Examiner* — Hoai V Pham
(74) *Attorney, Agent, or Firm* — Rossi, Kimms & McDowell LLP

(57) ABSTRACT

A sound signal outputting device includes a receiving section which receives signals on a plurality of channels, a band splitting section which splits the signals on the plurality of channels to produce low-frequency signals whose frequencies are lower than a predetermined frequency respectively, a separating section which separates a correlated component and uncorrelated components between predetermined channels from the low-frequency signals on the plurality of channels, an uncorrelated component outputting section which applies a first directivity to the uncorrelated components of the signals on respective channels to output applied components, and a correlated component outputting section applies a second directivity to the correlated component of the signals on respective channels to output an applied component.

11 Claims, 4 Drawing Sheets

SOUND SIGNAL OUTPUTTING DEVICE, SOUND SIGNAL OUTPUTTING METHOD, AND COMPUTER-READABLE RECORDING MEDIUM

BACKGROUND

The present invention relates to a sound signal outputting device, a sound signal outputting method, and a computer-readable recording medium.

Various speaker units capable of producing a surround-sound feeling by attaching a different characteristic to sounds output from a plurality of speaker units respectively have been proposed. For example, in the array speaker unit set forth in JP-A-2006-238155, an array speaker for outputting high-frequency sounds and woofers for outputting low-frequency sounds are provided. The signals on respective channels being input into the array speaker unit are separated into the low-frequency sounds and the high-frequency sounds. The low-frequency sounds are output from the woofers. In contrast, the high-frequency sounds are supplied from the array speakers. At that time, a different delay is attached every speaker unit constituting the array speaker. The high-frequency sounds output from respective speaker units interfere mutually in a space, and as a result the sound beam is produced toward a predetermined direction. Such sound beam is produced on respective channels. Respective sound beams arrive at the listener after they are reflected from the wall surface, and the like of the room. Consequently, the surround-sound feeling can be caused in the listener as if the speakers are arranged at plural locations of the room.

In the technology set forth in JP-A-2006-238155, the direction control of the sound beam (referred to as the "directivity control" hereinafter) is applied by controlling delay times of the sounds being output from respective speaker units. However, constraint based upon the principle is imposed upon the directivity control. That is, in order to control the low-frequency sounds (long wavelength), the array whose width is very wide is needed and inevitably an enclosure of the array speaker unit must be extended in length. Also, in order to control the high-frequency sounds (short wavelength), the speaker units of small diameter must be aligned at a narrow pitch. However, a width of the enclosure cannot be ensured without limitation for the reason of design of the speaker unit, so that the speaker units of small diameter cannot have an enough low-frequency reproducing performance.

In view of the above limitation, in the array speaker unit set forth in JP-A-2006-238155, both the "surround-sound feeling" and the "low-frequency reproduction" are implemented by classifying the frequency components into a low-frequency band and a high-frequency band such that the directivity control is applied only to the high-frequency band and the low-frequency component is reproduced by the woofers. However, according to such technology, no directivity control is applied to the low-frequency component output from the woofers and thus the low-frequency component is located in front of the listener. As a result, the listener cannot feel the surround-sound feeling from the low-frequency component.

Meanwhile, as the typical sound in the low-frequency band and the medium low-frequency band, the low-pitched musical instrument such as a bass drum, a base, or the like and the fundamental of a human voice are cited. Respective sound sources are often aligned such that these sound are located in a center in producing the contents. At this time, even though the contents having the center channel are provided, there is such a tendency that, in view the fact that two-channel production and reproduction are the mainstream in the prior art, the same signals are still allocated to the left and right front channels (the so-called main channels). It is clearly intended that these sounds in the low-frequency band should be located in the center.

Therefore, even when either the array speaker unit whose low-frequency reproducing performance is high is provided or the array speaker for the low-frequency band only is employed, the problem still existed in producing the surround-sound feeling on the low-frequency band. In other words, when the same signals allocated to the left and right front channels are separately controlled, either the location and the articulation are deteriorated markedly or a sound pressure is attenuated on account of the superposition of the left and right channels whose phases are different and a loss of the low-pitched sound feeling occurs.

SUMMARY

The present invention has been made in view of the foregoing circumstances, and provides the technology to produce a surround sound field of a high quality.

A sound signal outputting device according to the present invention, includes:

a receiving section which receives signals on a plurality of channels;

a band splitting section which splits the signals on the plurality of channels to produce low-frequency signals whose frequencies are lower than a predetermined frequency respectively;

a separating section which separates a correlated component and uncorrelated components between predetermined channels from the low-frequency signals on the plurality of channels;

an uncorrelated component outputting section which applies a first directivity to the uncorrelated components of the signals on respective channels to output applied components; and a correlated component outputting section applies a second directivity to the correlated component of the signals on respective channels to output an applied component.

Preferably, the first directivity is set to a right direction or a left direction with respect to a front direction as a directivity center, and the uncorrelated components produce a surround sound field by a reverberation in a sound field space.

Preferably, the sound signal outputting device further includes an instantaneous signal level measuring section which measures instantaneous sound pressures of the low-frequency signals on the predetermined channels. The separating section separates the correlated component and the uncorrelated components from the low-frequency signals on the plurality of channels, based on the instantaneous sound pressures.

Preferably, the sound signal outputting device according to claim 1, further includes a filtering section which processes predetermined signals contained in the low-frequency signals on the plurality of channels by using adaptive filters, the adaptive filters employing the low-frequency signals on other plurality of channels as a target signal respectively, to produce a simulated signal. The separating section separates the correlated component and the uncorrelated components based on the simulated signal.

Preferably, the band splitting section splits the signals on the plurality of channels received by the receiving section to produce high-frequency signals whose frequencies are higher than a predetermined frequency respectively. The sound signal outputting device further includes a high-frequency surround outputting section which outputs the high-frequency signals on the plurality of channels as a surround sound reproduction.

Here, it is preferable that, the uncorrelated component outputting section and the correlated component outputting section are a plurality of low-frequency reproducing woofers. The high-frequency surround outputting section is an array speaker having a plurality of speaker units.

According to the present invention, there is also provided a sound signal outputting method, comprising:

receiving signals on a plurality of channels;

splitting the signals on the plurality of channels to produce low-frequency signals whose frequencies are lower than a predetermined frequency respectively;

separating a correlated component and uncorrelated components between predetermined channels from the low-frequency signals on the plurality of channels;

applying a first directivity to the uncorrelated components of the signals on respective channels to output applied components; and applying a second directivity to the correlated component of the signals on respective channels to output an applied component.

According to the present invention, there is also provided a computer-readable recording medium recording a program for causing a computer to execute a sound signal outputting method, comprising:

receiving signals-on-a-plurality of channels;

splitting the signals on the plurality of channels to produce low-frequency signals whose frequencies are lower than a predetermined frequency respectively;

separating a correlated component and uncorrelated components between predetermined channels from the low-frequency signals on the plurality of channels;

applying a first directivity to the uncorrelated components of the signals on respective channels to output applied components; and applying a second directivity to the correlated component of the signals on respective channels to output an applied component.

According to the sound signal outputting device, the sound signal outputting method, and the computer-readable recording medium according to the present invention, the surround sound field of the high quality can be produced. Concretely, the surround-sound feeling and the expansion feeling of the output low-pitched sound can be improved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A: The Principle of Directivity Control

First, the principle of directivity control by attaching a delay will be explained briefly hereunder. The sound signals being output from one speaker unit spread out spherically into space. When the same sound signals are output from a plurality of speakers, superposition occurs in respective points of the space, and thus a sound pressure is increased at points where phases of respective outputs are coherent in the direction in which wavefronts of respective outputs coincide with each other. Here, points and directions in which the phases of respective outputs coincide with each other can be set by giving a predetermined delay to the sound signals output from the speakers respectively. As a result, the direction characteristic can be provided in a particular direction.

In the array speaker, the number of speakers is increased, the synchronous adding effect in the points and directions in which the phases of respective outputs coincide with each other can be increased and thus the very sharp directivity can be implemented. The sounds with the sharp directivity are called the "beam". Also, when the signals on plural channels are output from the speakers to superpose mutually while attaching the delay to the signals respectively, a predetermined directivity can be attached separately to the outputs on plural channels respectively.

B: Configuration

A configuration of an array speaker device 1 (a sound signal outputting device) according to an embodiment of the present invention will be explained hereunder.

(B-1: External Appearance of the Array Speaker Device 1)

Figure 1:
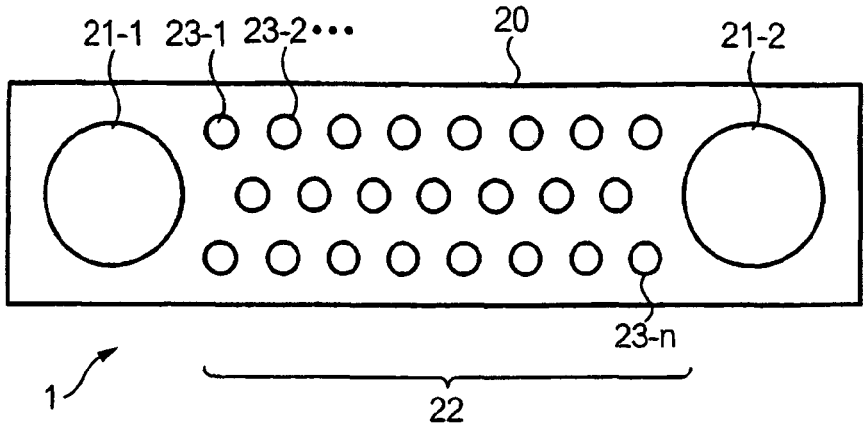
FIG. 1 is a view showing an external appearance of an array speaker device.

FIG. 1 is a view showing an external appearance (front) of the array speaker device 1. As shown in FIG. 1, an array speaker 22 is arranged in a center portion of an enclosure 20 of the array speaker device 1. The array speaker 22 is composed of speaker units 23-1, 23-2, . . . , **23-*n*. A woofer 21-1 is provided on the left side when viewed from the front and a woofer 21-2 is provided on the right side (referred generically to as woofers 21** hereinafter when it is not needed to distinguish them mutually).

The array speaker device 1 processes the sound in a high-frequency band (high-frequency component) and the sound in a low-frequency band (low-frequency component) separately, and outputs them from the array speaker 22 and the woofers 21 respectively. Therefore, configurations concerning the processes of the high-frequency component and the low-frequency component will be explained respectively hereunder.

(B-2: Configuration Concerning the Process of the High-Frequency Component)

Figure 2:
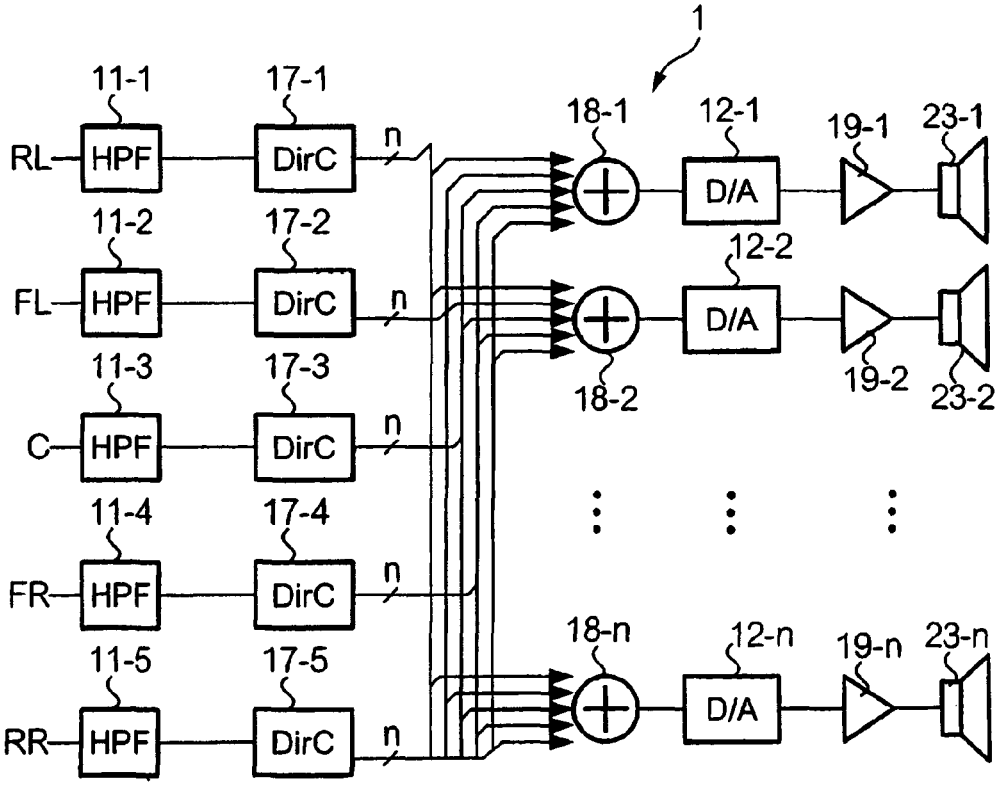
FIG. 2 is a block diagram showing a configuration of the array speaker device concerning a process of a high-frequency component.

FIG. 2 is a block diagram showing schematically the configuration of the array speaker device 1 concerning the process of the high-frequency component.

As shown in FIG. 2, in the array speaker device 1, the signals being converted into digital data on five channels (front left (FL)/right (FR), rear left (RL)/right (RR), and center (C) channels) are processed. The signals on respective channels RL, FL, C, FR, RR are input into high-pass filters (HPFs) 11-1 to 11-5 provided corresponding to the respective channels. Then, high-frequency components that are higher than a predetermined crossover frequency are extracted, and then are input into directivity controlling portions (DirCs) 17-1 to 17-5.

A delay circuit is provided to the directivity controlling portions 17-1 to 17-5 respectively, and the delay circuits correspond to the speaker units 23-1 to **23-*n* constituting the array speaker 22** respectively. A delay time is set in respective delay circuits such that the output sound signal on the concerned channel is shaped into the beam in a predetermined direction.

Also, adding portions 18-1 to **18-*n* receive the signals from the directivity controlling portions 17-1 to 17-5 and add them respectively. The added signals are output to D/A converters 12-1 to 12-*n*** respectively.

The D/A converters 12-1 to **12-*n* convert the received digital data into analog signals (sound signals). The analog signals converted in the D/A converters 12-1 to 12-*n* are output to power amplifiers 19-1 to 19-*n*** respectively.

The power amplifiers 19-1 to **19-*n* amplify the received signal respectively, and output the amplified signals to the speaker units 23-1 to 23-*n*** provided correspondingly.

The speaker units 23-1 to **23-*n*** emit the sound based on the received signal respectively.

(B-3: Configuration Concerning the Process of the Low-Frequency Component)

Figure 4:
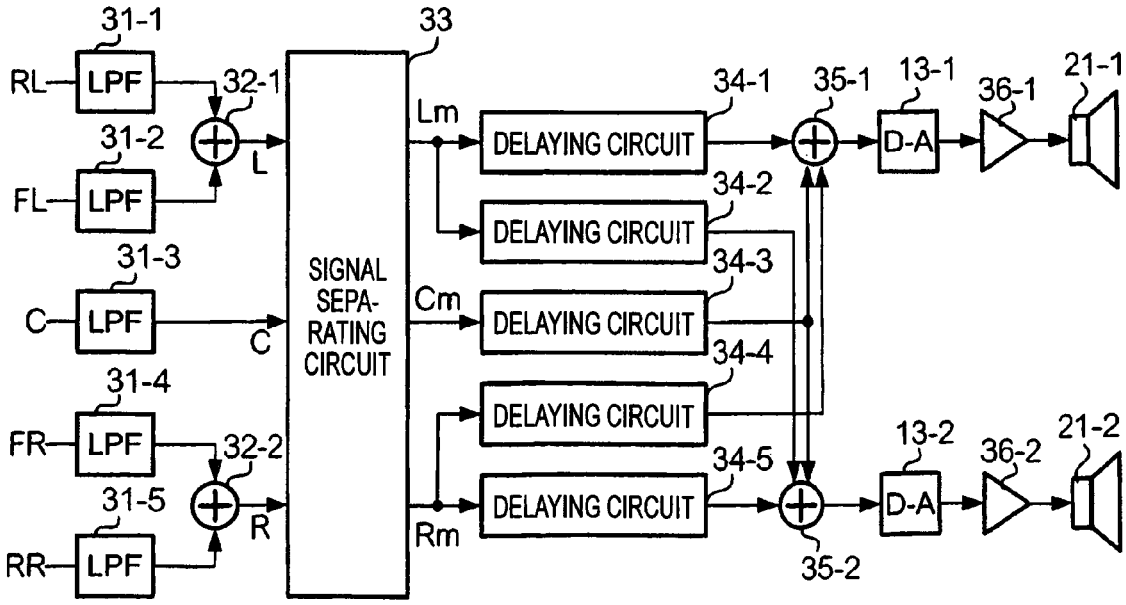
FIG. 4 is a block diagram showing a configuration of the array speaker device concerning a process of a low-frequency component.

FIG. 4 is a block diagram showing schematically a configuration of the array speaker device 1 concerning the process of the low-frequency component.

As shown in FIG. 4, the above signals on five channels (FL, FR, RL, RR, C) are processed as follows. The signals on respective channels RL, FL, C, FR, RR are input into low-pass filters (LPFs) 31-1 to 31-5 provided to correspond to the channels respectively. Then, low-frequency components that are lower than a predetermined crossover frequency are extracted.

Then, signals being output from the LPFs 31-1 and 31-2 (low-frequency components on RL and FL) are added in an adding portion 32-1. Thus, a new signal (referred to as a left signal L hereinafter) is produced and is input into a signal separating circuit 33.

Also, signals being output from the LPFs 31-4 and 31-5 (low-frequency components on FR and RR) are added in an adding portion 32-2. Thus, a new signal (referred to as a right signal R hereinafter) is produced and is input into the signal separating circuit 33.

Also, a signal being output from the LPF 31-3 (low-frequency component on C) is output directly to the signal separating circuit 33. This signal is call a center signal C hereunder.

The signal separating circuit 33 receives the left signal L, the right signal R, and the center signal C. The signal separating circuit 33 separates a "correlated signal Cm" and "uncorrelated signals Lm and Rm" from the left signal L, the right signal R, and the center signal C. A signal processing method in the signal separating circuit 33 will be explained hereunder.

Figure 5:
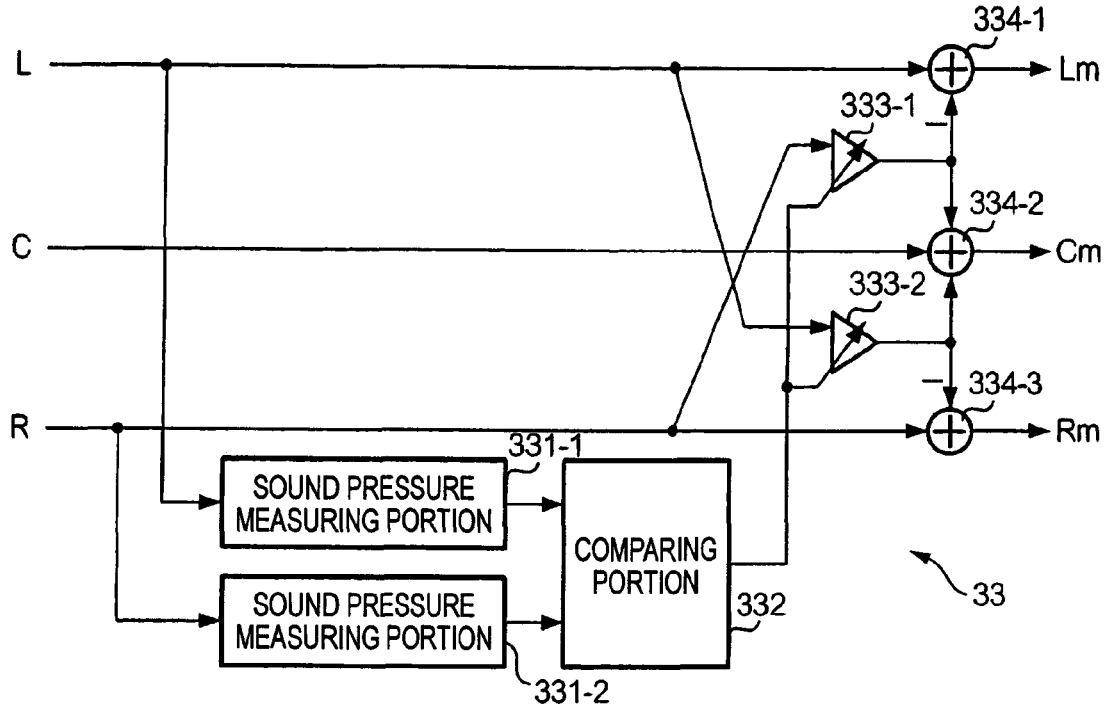
FIG. 5 is a block diagram showing an example of a configuration of a signal separating circuit 33.

FIG. 5 is a block diagram showing an example of a configuration of the signal separating circuit 33. Respective signals being input into the signal separating circuit 33 are processed by the circuits shown in FIG. 5.

First, sound pressure measuring portions 331-1 and 331-2 measure an instantaneous sound pressure of the left signal L and the right signal R. That is, the sound pressure measuring portions attach a constant of variation to absolute values of respective signals.

A comparing portion 332 compares the instantaneous sound pressure of the left signal L and the right signal R measured by the sound pressure measuring portions 331-1 and 331-2, and calculates a matrix coefficient α that can assume a value from 0 to 1. As a method of calculating the matrix coefficient α, Formula 1 given as follows may be applied, for example. In Formula 1, L1 and R1 denote an instantaneous sound pressure of the left signal L and the right signal R respectively.

$$\alpha = 1 - \frac{|Ll| - |Rl|}{|Ll| + |Rl|} \quad \text{(Formula 1)}$$

Then, gain controlling portions 333-1 and 333-2 and adders 334-1 to 334-3 calculate the correlated signal Cm and the uncorrelated signals Lm and Rm according to Formula 2, based on the left signal L, the right signal R, and the center signal C and the matrix coefficient α calculated by the comparing portion 332, and outputs these signals.

$$Cm = C + \alpha \times (L + R)$$

$$Lm = L - \alpha \times R$$

$$Rm = R - \alpha \times L \quad \text{(Formula 2)}$$

Returning to FIG. 4 again, the uncorrelated signal Lm produced in the signal separating circuit 33 is output to delaying circuits 34-1 and 34-2. Also, the correlated signal Cm is output to a delaying circuit 34-3. The uncorrelated signal Rm is output to delaying circuits 34-4 and 34-5.

The delaying circuits 34-1 and 34-2 delay the uncorrelated signal Lm by a predetermined time respectively. At this time, delay times are set such that the uncorrelated signals Lm that are delayed and to be output from the speakers 21-1 and 21-2 should have a predetermined directivity. Similarly, the delaying circuits 34-4 and 34-5 delay the uncorrelated signal Rm by a predetermined time respectively.

The delaying circuit 34-3 delays the correlated signal Cm by a predetermined time. This delay is given to make a timing of the correlated signal Cm at the listener coincide with timings of the uncorrelated signals Lm and Rm.

An adding portion 35-1 receives the uncorrelated signals Lm from the delaying circuit 34-1, the correlated signal Cm from the delaying circuit 34-3, and the uncorrelated signal Rm from the delaying circuit 34-4, and superposes the received signals mutually. An adding portion 35-2 receives the uncorrelated signals Lm from the delaying circuit 34-2, the correlated signal Cm from the delaying circuit 34-3, and the uncorrelated signal Rm from the delaying circuit 34-5, and superposes the received signals mutually. The adding portions 35-1 and 35-2 output the produced signals to D/A converters 13-1 and 13-2 respectively.

The D/A converters 13-1 and 13-2 convert received digital data into analog signals (sound signals), and output the analog signals to power amplifiers 36-1 and 36-2 respectively. The power amplifiers 36-1 and 36-2 amplify the received signals, and output the amplified signals to the woofers 21-1 and 21-2 respectively.

The woofers 21-1 and 21-2 emit the sound based on the received signal respectively.

C: Operation

Next, the processes of the high-frequency component and the low-frequency component in the array speaker device 1 according to the present invention will be explained hereunder.

(C-1: Process of the High-Frequency Component)

First, a mode of surround reproduction of the high-frequency component will be explained briefly hereunder.

As shown in FIG. 2, the high-frequency components are extracted from the signals on five channels (RL, FL, C, FR, and RR) by the HPFs 11-1 to 11-5, then are delayed by the directivity controlling portions 17-1 to 17-5, and then are fed to all array speaker units 23-1 to **23-*n* respectively. At this time, the directivity controlling portions 17-1 to 17-5 attach a predetermined delay time respectively such that outputs from respective speaker units are put in phase with each other in predetermined positions in the space. As a result, the sounds output from the array speaker 22** on respective channels are shaped into the beam in the predetermined direction respectively.

Figure 3:
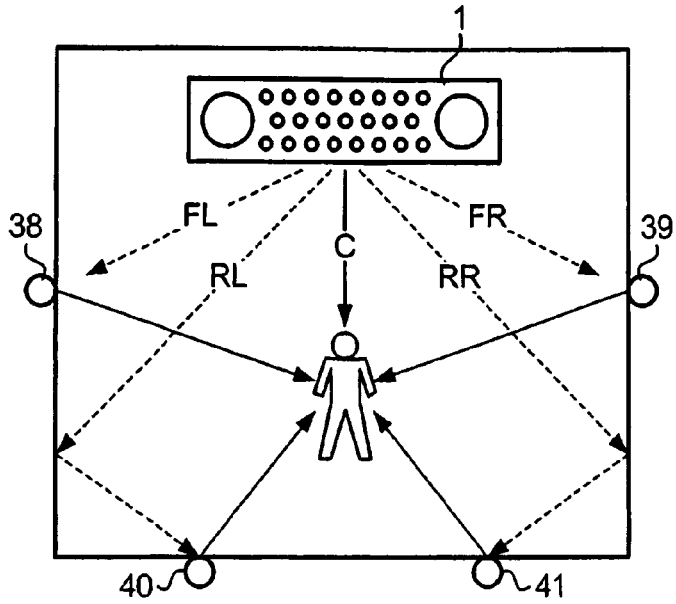
FIG. 3 is a view showing beam paths of a high-frequency signal produced by the array speaker device.

FIG. 3 shows schematically beam paths of the sound in the space in which is the array speaker device 1 is set up. The high-frequency components on the front channels (FL and FR) and the rear channels (RL and RR) are reflected by the wall surface, and then arrive at the listener. Therefore, the listener can perceive the sound sources in the wall surface directions (directions of 38, 39, 40 and 41) from which the sound beam is reflected, so that the surround sound field is produced.

(C-2: Process of the Low-Frequency Component)

Next, a mode of the surround sound reproduction of the low-frequency component will be explained hereunder.

As shown in FIG. 4, the signals on five channels (RL, FL, C, FR, and RR) are reproduced as the low-frequency left signal L, the low-frequency right signal R, and the center signal C by the LPFs 31-1 to 31-5 and the adding portions 32-1 and 32-2. Then, these signals are reproduced as the uncorrelated signals Lm and Rm and the correlated signal Cm by the signal separating circuit 33.

A predetermined delay is given to the uncorrelated signal Lm by the delaying circuits 34-1 and 34-2 respectively, and both delayed signals are fed to the woofers 21-1 and 21-2. At this time, a predetermined delay time is given such that the outputs from both woofers are in phase with each other in the predetermined direction.

Similarly, a predetermined delay is given to the uncorrelated signal Rm by the delaying circuits 344 and 34-5 respectively, and both delayed signals are fed to the woofers 21-1 and 21-2.

A predetermined delay is given to the correlated signal Cm by the delaying circuit 34-3, and delayed signal is fed in phase to the woofers 21-1 and 21-2.

Figure 7:
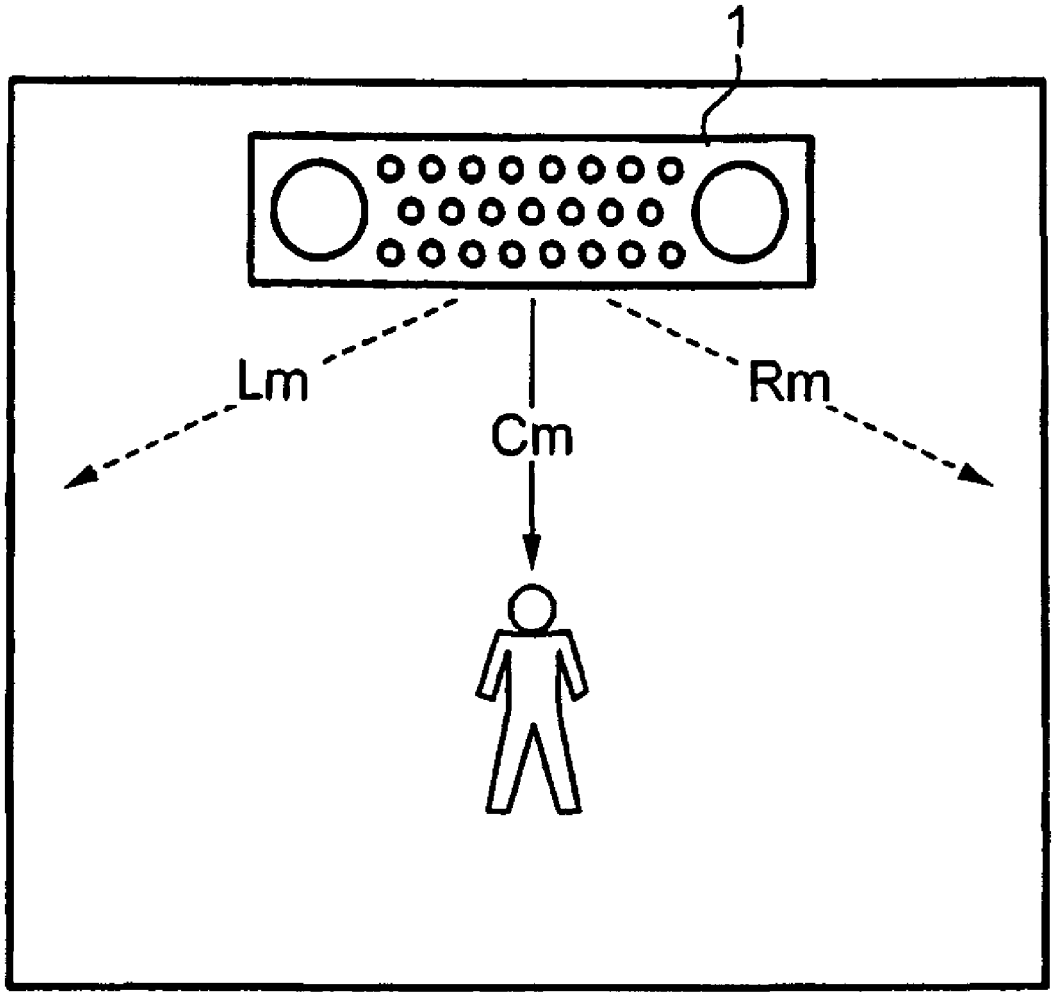
FIG. 7 is a view showing directivities of the low-frequency signals being output from the array speaker device.

FIG. 7 shows an image of main direction centers of the low-frequency components, i.e., the traveling direction of the wavefronts, in the space in which the array speaker device 1 is provided. On account of the superposition of both woofer outputs, the uncorrelated signals Lm emitted from the woofers 21-1 and 21-2 have the main direction center in the left direction of the listener. Therefore, a ratio of the sound reverberated from the left side to the sound coming from the front side is increased relatively. As a result, the listener feels an expansion of the sound field in the left direction.

Similarly, the uncorrelated signals Rm have the main direction center in the right direction of the listener. As a result, the listener feels an expansion of the sound field in the right direction.

In contrast, the correlated signal Cm whose sound image is to be located in the front center are output in phase from the woofers 21-1 and 21-2. As a result, the sound image can be located in the front center.

In this manner, the left and right low-frequency signals are reproduced as the surround sounds not to lose the center location of the correlated components.

(C-3: Separating Process of Correlated/Uncorrelated Components)

In the low-frequency signal, often the same sounds are allocated to the left and right channels. In such case, when the directivity control is applied, serious detrimental effects are caused such that a feeling of the low-pitched sound is spoiled, the location of sound image becomes indistinct; and the like. Therefore, the correlated component and the uncorrelated components must be separated. An embodiment for that purpose is explained by using FIG. 5, Formula 1 and Formula 2 hereunder.

In FIG. 5, the sound pressure measuring portions 331-1 and 331-2 measure the sound pressure of the left signal L and the right signal R, and then the comparing portion 332 compares both signals. Then, the comparing portion produces the matrix coefficient $\alpha$ whose value becomes close to 0 when a difference between the sound pressures is large where becomes close to 1 when a difference between the sound pressures is small, and thus the correlation components are given as $\alpha \times L$ and $\alpha \times R$ respectively. Namely, the correlation is decided in terms of the comparison between the sound pressures.

This method is the very simple method, and therefore this method can be accomplished by the very small processing resource. On the contrary, since a frequency band of the signal as the processed object is narrow, this method operates as the relatively good correlation/uncorrelation separating circuit and is practical in use.

Figure 6:
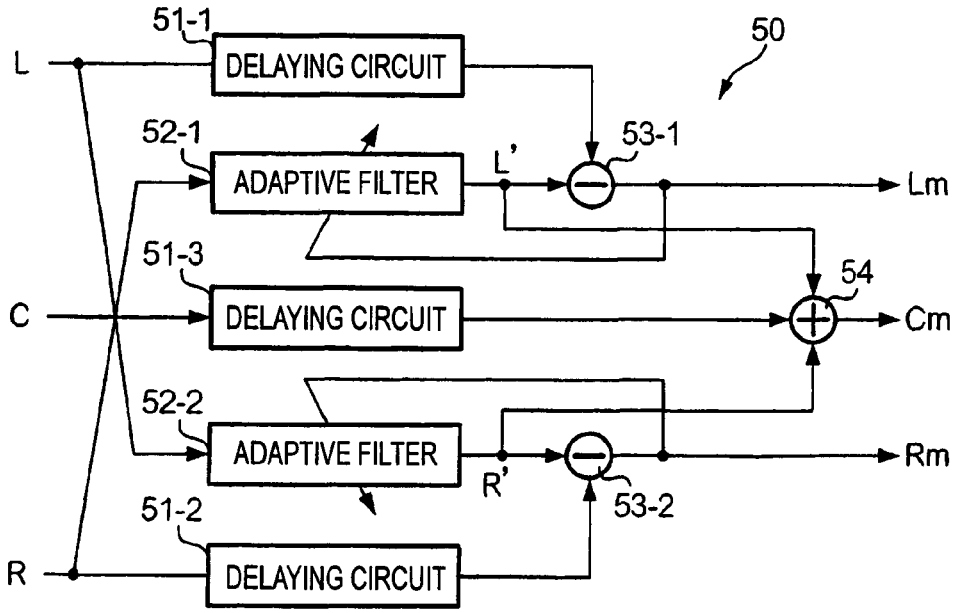
FIG. 6 is a block diagram showing a signal separating circuit 50 as an example of another configuration of the signal separating circuit 33.

FIG. 6 shows an embodiment of a signal separating circuit 50 that can be used instead of the signal separating circuit 33, and the more popular correlation calculating system is employed.

Adaptive filters 52-1 and 52-2 are the FIR filter that is well known in the prior art respectively. The adaptive filter 52-1 transforms the input right signal R based on a set coefficient, and outputs a simulated left signal L'. A difference calculating portion 53-1 calculates an error signal as a difference between the left signal L as the target signal and the simulated left signal L'. The error signal is fed back to the coefficient of the adaptive filter 52-1, and the coefficient is reset to reduce the error signal. According to this process, the simulated left signal L' as the output of the adaptive filter is extracted as the correlation component between the left signal L and the right signal R. At the same time, the error signal becomes the uncorrelated component, and is output as the uncorrelated signal Lm. When the left signal L is input while using the right signal R as the target signal, the adaptive filter 52-2 and a difference calculating portion 53-2 output a simulated right signal R' as the correlation component and the uncorrelated signal Rm according to the similar process.

The simulated left signal L' and the simulated right signal R' serving as the correlation components are superposed on the center signal C by an adder 54, and the superposed signal is output as the correlated signal Cm. Here, delaying circuits 51-1 to 51-3 are the circuit provided to synchronize the delay in the adaptive filter which entails a group delay with the delays in other circuits.

In this case, the method of calculating the coefficient of the adaptive filter may be executed in accordance with the standard LMS algorithm, the RMS algorithm, or the like.

D: Summary

As described above, in the array speaker device 1, the different reproduction is applied to the high-frequency component and the low-frequency component of the signals on the channels respectively. In the high-frequency component, the surround sound reproduction known in the prior art is applied by shaping the sounds on respective channels into the beams and then outputting the beams. In contrast, the low-frequency signals are processed as follows. That is, the low-frequency signals are separated into the correlated signal Cm and the uncorrelated signals Lm and Rm. The correlated signal Cm is output in phase from two woofers, and produces the distinct sound image in the front center. On the contrary, the directivity of the uncorrelated signals Lm and Rm is controlled in the left and right directions, and the reverberated sound is relatively increased from the left and right sides. As a result, the listener feels the expansion of the sound field.

E: Variation

With the above, the embodiment of the present invention is explained. But the present invention is not limited to the above embodiment, and various other modes can be carried out.

In the above embodiment, the low-frequency signal is output from two woofers. But three woofers or more may be employed. In such case, a delay signal to be given to the uncorrelated signals respectively may be set respectively, and a predetermined directivity may be given.

In the above embodiment, the case where the reproduced signal is fed on five channels is explained by way of example. But the present invention can be applied to the case of two channels. In this case, the adding portions in FIG. 4 may be omitted and the paths of the center channel C may be omitted.

Also, the present invention can be applied to other multi-channel systems such as the 7.1 channels. In this case, the right signal R, the left signal L, and the center signal C may be produced adequately by the adding portions in FIG. 4.

The control program executed by respective portions of the array speaker device 1 in the above embodiment may be provided in a state that this program is recorded in the magnetic recording medium (magnetic tape, magnetic disk (HDD, FD), or the like), the optical recording medium (optical disk (CD, DVD), or the like), the computer-readable recording medium such as magneto-optic recording medium, semiconductor memory, or the like. Also, the program may be downloaded via the network such as the Internet, or the like.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2008-054491 filed on Mar. 5, 2008, the contents of which are incorporated herein by reference.

What is claimed is:

1. A sound signal outputting device for outputting sound signals of a plurality of channels to a speaker system having an array speaker unit with a plurality of array speakers and a plurality of non-array speakers, the sound outputting device comprising:

a receiving section that receives a plurality of sound signals of a plurality of channels;

a band splitting section that splits each of the received plurality of signals of the respective plurality of channels to produce a low-frequency signal having frequencies lower than a predetermined frequency and a high-frequency signal having frequencies higher than the predetermined frequency;

a separating section that separates a correlated component and uncorrelated components between first predetermined channels among the plurality of channels from only the low-frequency signals thereof;

an uncorrelated component outputting section that applies a first directivity only to the low-frequency signal of the uncorrelated components separated by the separation section and outputs the low-frequency signal applied with the first directivity to the non-array speakers; and a correlated component outputting section that applies a second directivity only to the low-frequency signal of the correlated component separated by the separation section and outputs the low-frequency signal applied with the second directivity to the non-array speakers.

2. The sound signal outputting device according to claim 1, wherein the first directivity is set to a right or left direction with respect to a front direction taken as a directivity center, and the low-frequency signal of the uncorrelated components applied with the second directivity produces a surround sound field by a reverberation in a sound field space.

3. The sound signal outputting device according to claim 1, further comprising:

an instantaneous signal level measuring section that measures instantaneous sound pressures of the low-frequency signals of the first predetermined channels, wherein the separating section separates the correlated component and the uncorrelated components from only the low-frequency signals of the first predetermined channels, based on the measured instantaneous sound pressures.

4. The sound signal outputting device according to claim 1, further comprising:

a filtering section that processes predetermined signals contained in the low-frequency signals of second predetermined channels among the first predetermined channels with adaptive filters employing the low-frequency signals of other channels of the second predetermined channels as a target signal respectively, to produce a simulated signal, wherein the separating section separates the correlated component and the uncorrelated components based on the simulated signal.

5. The sound signal outputting device according to claim 1, further comprising a high-frequency surround outputting section that outputs the high-frequency signals of second predetermined channels among the plurality of channels as a surround sound reproduction to the array speaker unit.

6. The sound signal outputting device according to claim 1, wherein the non-array speakers are a plurality of low-frequency reproducing woofers.

7. The sound signal outputting device according to claim 1, wherein:

the non-array speakers comprises a left woofer and a right woofer, the uncorrelated component outputting section splits the low-frequency signal of the uncorrelated components separated by the separating section into a first low-frequency signal and a second low-frequency signal, and includes a first delay circuit that delays the first low-frequency signal by a first predetermined time, and a second delay circuit that delays the second low-frequency signal by a second predetermined time, and outputs the first low-frequency signal delayed by the first predetermined time to one of the left or right woofer, and outputs the second low-frequency signal delayed by the second predetermined time to the other of the left or right woofer to create the first directivity, and the correlated component outputting section includes a third delay circuit that delays the low-frequency signal of the correlated component separated by the separation section by a third predetermined time, outputs the low-frequency signal delayed by the third predetermined time to both the left woofer and the right woofer to create the second directivity.

8. A sound signal outputting method for a sound signal outputting device for outputting sound signals of a plurality of channels to a speaker system having an array speaker unit with a plurality of array speakers and a plurality of non-array speakers, the method comprising the steps of:

receiving a plurality of signals of a plurality of channels;

splitting each of the plurality of signals of the respective plurality of channels to produce a low-frequency signal having frequencies lower than a predetermined frequency and a high-frequency signal having frequencies higher than the predetermined frequency;

separating a correlated component and uncorrelated components between predetermined channels among the plurality of channels from only the low-frequency signals thereof;

applying a first directivity only to the low-frequency signal of the uncorrelated components separated by the separating step outputs the low-frequency signal applied with the first directivity to the non-array speakers; and applying a second directivity only to the low-frequency signal of the correlated component separated by the separation section and outputs the low-frequency signal applied with the second directivity to the non-array speakers.

9. The sound signal outputting method according to claim 8, wherein:

the non-array speakers comprises a left woofer and a right woofer, the first directivity applying step includes splitting the low-frequency signal of the uncorrelated components separated by the separating section into a first low-frequency signal and a second low-frequency signal, delaying the first low-frequency signal by a first predetermined time, and delaying the second low-frequency signal by a second predetermined time, outputting the first low-frequency signal delayed by the first predetermined time to one of the left or right woofer and outputting the second low-frequency signal delayed by the second predetermined time to the other of the left or right woofer to create the first directivity, and the second directivity applying step includes delaying the low-frequency signal of the correlated component separated by the separation step by a third predetermined time and outputting the low-frequency signal delayed by the third predetermined time to both the left and right woofers to create the second directivity.

10. A non-transitory computer-readable storing medium storing a computer program executable by a computer to execute a sound signal outputting method comprising the steps of:

receiving a plurality of signals of a plurality of channels;

splitting each of the plurality of signals of the respective plurality of channels to produce a low-frequency signal having frequencies lower than a predetermined frequency and a high-frequency signal having frequencies higher than the predetermined frequency;

separating a correlated component and uncorrelated components between predetermined channels among the plurality of channels from only the low-frequency signals thereof;

applying a first directivity only to the low-frequency signal of the uncorrelated components separated by the separating step outputs the low-frequency signal applied with the first directivity to the non-array speakers; and applying a second directivity only to the low-frequency signal of the correlated component separated by the separation section and outputs the low-frequency signal applied with the second directivity to the non-array speakers.

11. The non-transitory computer-readable storage medium according to claim 10, wherein:

the non-array speakers comprises a left woofer and a right woofer, the first directivity applying step includes splitting the low-frequency signal of the uncorrelated components separated by the separating section into a first low-frequency signal and a second low-frequency signal, delaying the first low-frequency signal by a first predetermined time, and delaying the second low-frequency signal by a second predetermined time, outputting the first low-frequency signal delayed by the first predetermined time to one of the left or right woofer and outputting the second low-frequency signal delayed by the second predetermined time to the other of the left or right woofer to create the first directivity, and the second directivity applying step includes delaying the low-frequency signal of the correlated component separated by the separation step by a third predetermined time and outputting the low-frequency signal delayed by the third predetermined time to both the left and right woofers to create the second directivity.

* * * * *